US006368023B1

(12) United States Patent
Lau

(10) Patent No.: US 6,368,023 B1
(45) Date of Patent: Apr. 9, 2002

(54) JACK-IN PILING SYSTEMS' APPARATUS AND THEIR METHOD OF USE

(76) Inventor: Sing Hian Bing Hian Lau, 24-1, Jin 1/1490 Taman Sri Petaling, Kuala Lumpur (MY), 57000

( * ) Notice: Subject to any disclaimer, the term of this patent is extended or adjusted under 35 U.S.C. 154(b) by 0 days.

(21) Appl. No.: 09/579,612

(22) Filed: May 26, 2000

(30) Foreign Application Priority Data

May 31, 1999 (MY) ..... PI 9902159

(51) Int. Cl.[7] ..... E02D 7/20
(52) U.S. Cl. ..... 405/232; 173/53
(58) Field of Search ..... 405/230, 232, 405/247, 246, 228, 229; 173/90, 53, 112, 91; 254/29 R

(56) References Cited

U.S. PATENT DOCUMENTS

| | | | | |
|---|---|---|---|---|
| 4,925,345 A | * | 5/1990 | McCown, Jr. et al. | 405/228 |
| 4,997,314 A | * | 3/1991 | Hartman | 405/236 |
| 5,161,625 A | * | 11/1992 | Seng | 173/53 |
| 5,253,958 A | | 10/1993 | Bellemare | |
| 6,193,442 B1 | * | 2/2001 | May | 405/232 |

FOREIGN PATENT DOCUMENTS

| | | | | |
|---|---|---|---|---|
| BE | 1002952 | * | 9/1991 | |
| DE | 2817017 | * | 11/1979 | |
| GB | 2248082 | * | 3/1992 | E02D/5/38 |
| GB | 2 261 008 A | | 5/1993 | |
| GB | 2 291 911 A | | 2/1996 | |
| JP | 57197324 | * | 12/1982 | |

OTHER PUBLICATIONS

Search Report, dated May 4, 2001.*

* cited by examiner

*Primary Examiner*—David Bagnell
*Assistant Examiner*—Katherine W Mitchell
(74) *Attorney, Agent, or Firm*—Merchant & Gould P.C.

(57) ABSTRACT

A pile driving apparatus for jack-in piling system according to the invention utilises two hydraulic cylinder barrels moving along two vertical support structures. An uppermost horizontal member is employed to maintain a working space in between the two vertical support structures. The actuating rods are fixed to the uppermost horizontal member. The cylinder barrels are free in guided movement, exerting a force on a working pile with the assistance of two drive heads. In a first stroke of piling action, the upper drive head is employed to drive half of the working pile into the ground. In a second stroke, the lower drive head is employed to drive the rest of the pile into the ground.

7 Claims, 6 Drawing Sheets

Figure 1:
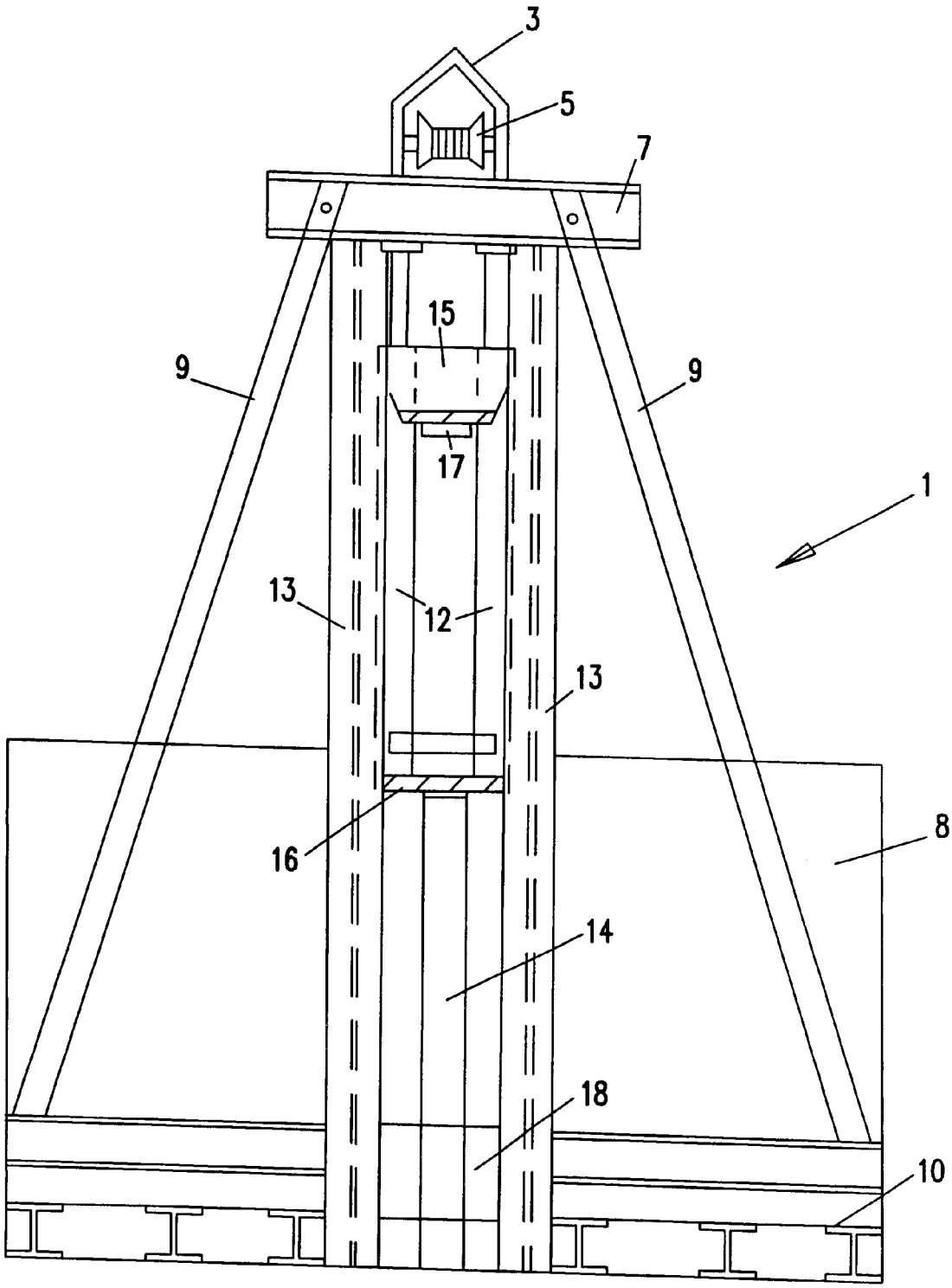

FIG. 2a
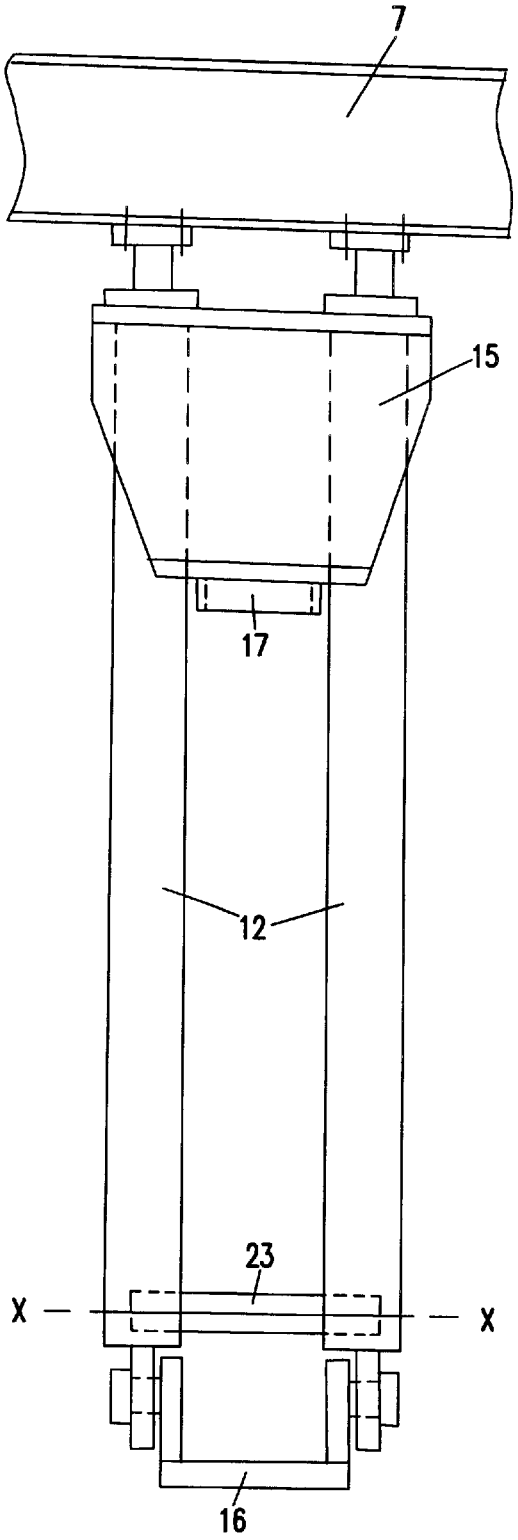
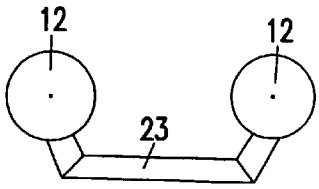
VIEW X–X
FIG. 2c
FIG. 2b
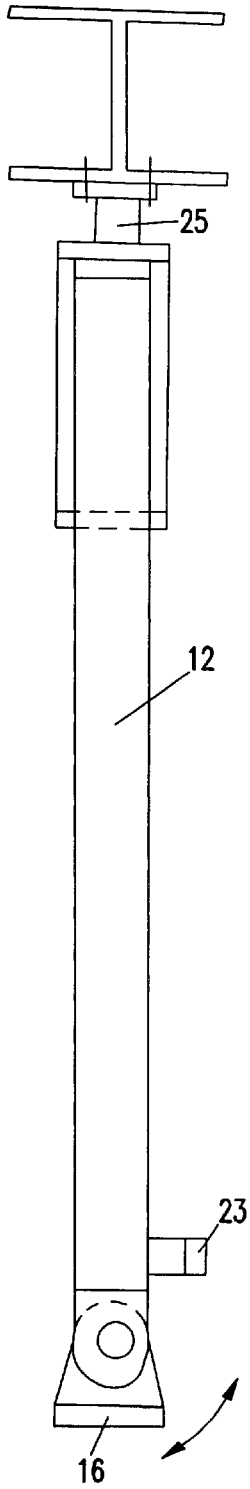

FIF. 3d

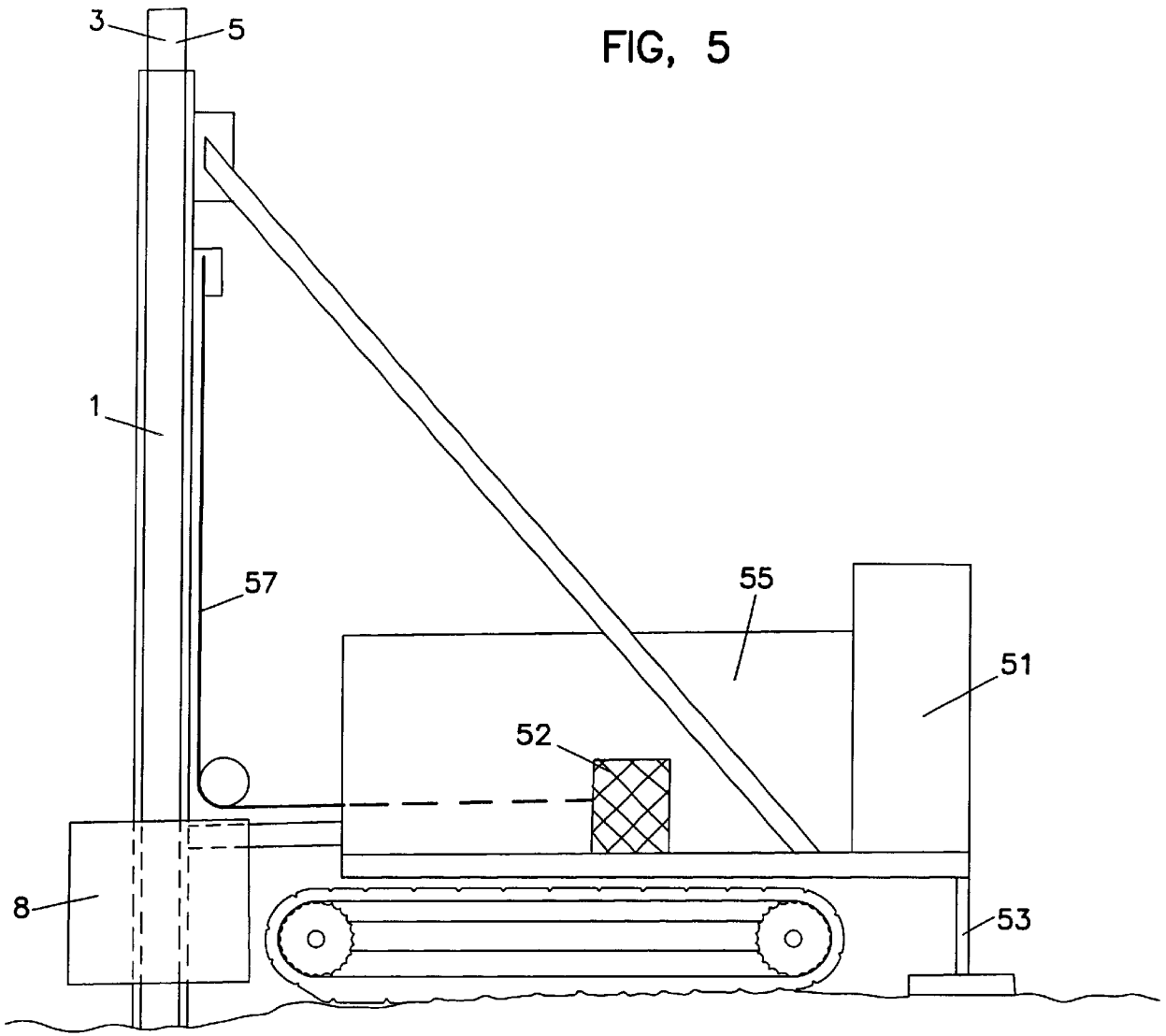
FIG, 5

JACK-IN PILING SYSTEMS' APPARATUS AND THEIR METHOD OF USE

TECHNICAL FIELD

This invention relates to improvement in apparatus used for injecting pile into ground using hydraulic cylinder system in foundation works.

BACKGROUND

Installation of pile into ground by various methods have been known for a long time. Installing pile by injecting it into ground using a hydraulically operated apparatus has been developed and improved upon.

Previously known apparatus employ single or multiple hydraulic cylinders in various configurations to inject pile into the ground by a direct application of force exerted by an actuating rod attached with a drive head. The barrel of the hydraulic cylinder is generally disposed above a pile to be worked, so that the actuating rod exerts a force to push the pile downward. This configuration requires a vertical support structure that is much taller than the pile, and suffers the disadvantages of headroom limitation and instability in shift One known apparatus has a single hydraulic cylinder positioned at the back of the pile with the drive head and a thrust plate connected by a thick plate. This, as in any single cylinder configuration, is unable to inject the whole length of pile into the ground without using a dolly. This exercise of using a dolly is time consuming and needs extra labour force. Multiple hydraulic cylinders are then used, as in another previously known apparatus, with a staggered configuration that enables the whole length of the pile to be injected without a dolly. This apparatus requires a tall and sizable vertical support structure to accommodate this complex multiple cylinder configuration.

Previously known apparatus is suitable for piles of shorter lengths i.e. 3 m to 6 m, and small sizes of 150 to 200 mm. Short piles have to be joined, normally by welding, hence are costly and time consuming. Joints in pile are also inherent weak points. Excessive joints are not encouraged especially in foundation of a new structure.

SUMMARY OF THE INVENTION

The present invention aims to provide a better alternative to known apparatus for injecting pile or the like by obviating the disadvantages highlighted above.

The invention provides a strong vertical support structure mounted either on to a platform or a movable carriage, with two hydraulic cylinder barrels positioned vertically side by side having a space in between them to accommodate a pile to be worked. The hydraulic cylinder barrels are disposed such that the end of two actuating rods are fixed rigidly to an uppermost horizontal member on top of the vertical support structures.

Previously known apparatus utilises hydraulic cylinder barrels in the conventional manner, such that the cylinder barrel is fixed and the actuating rod is movable with an attachment to exert a pushing or pulling force. The present invention is characterised in which the hydraulic cylinder barrels are disposed in reversed orientation to that of the conventional manner. The rod becomes fixed while the cylinder barrel is allowed to slide along a guide. One drive head adjoins the top ends of the two cylinder barrels. Another drive head adjoins the bottom ends of the two cylinder barrels.

The vertical support structure has to be strong to resist bending or buckling. It is fabricated preferably using two number of heavy steel H columns and joined at regular intervals with horizontal members. An uppermost horizontal member is a strong steel H section welded rigidly to the two larger vertical H columns. A winch and a hook is attached to the upper part of this uppermost horizontal member. The end of the two hydraulic actuating rods are attached to the bottom part of the uppermost horizontal member, preferably by bolts and nuts.

Two drive heads are used in this present invention. An upper drive head adjoins rigidly the two cylinder barrels at their mouths (top). This upper drive head is thick enough to account for the difference in length between the barrel and the rod of the cylinder, enabling a lower drive head to be locked in position during a second stroke. A cap is incorporated under the upper drive head for positioning the pile centrally between the two cylinder barrels during pitching. The lower drive head has an open and lock-in mechanism and is located at the base of the barrels. The two hydraulic cylinder barrels slide along the two vertical H columns with U section welded to the side as guides.

Retracted hydraulic cylinder barrels will have a length longer than half the length of a pile to be injected. Thus, when fully extended, its length will be longer than the pile, so that the whole pile can be injected into the ground. A complete piling operation involves two strokes. A first stroke commences, using the upper drive head to inject the pile. A second stroke then follows, employing the lower drive head. At the commencement of the first stroke, the cylinder barrels are fully retracted and the head of the pile to be worked is disposed directly beneath the upper drive head. The lower drive head is in 'open' position, allowing the pile through to reach the upper drive head.

The pile is centrally positioned and checked for verticality before a clamp at the lower portion of the support structure is locked in position to restrict any lateral movement of the pile. The simultaneous downward movement of the two cylinder barrels is exerting a force on the pile head through the drive head, pushing the pile into the ground. At the end of the first stroke, half the pile will be injected into the ground when the two hydraulic cylinder barrels are fully extended. The second stroke commences after the cylinder barrels are once again fully retracted and the lower drive head is locked in position by a mechanism. The downward movement of the two barrels is then repeated, but this time the force is exerted through the lower drive head. The whole length of the pile will be injected into the ground at the end of second stroke. The whole operation may be repeated when an extension pile is pitched and positioned beneath the upper drive head with the help of winch located at the top. Joining of piles could be carried out by welding or other means depending on the type of pile used.

It is the aim of present invention to drive piles of larger dimension and length. This is achieved by using hydraulic cylinder barrels of larger bore and length, and with the rods in compression, the downward force is enhanced. Larger or longer piles will pose problem during pitching, and greater effort is needed to prevent them from swinging around which may damage the hydraulic cylinders, especially the extended rods. In this present invention, the pile is positioned below the upper drive head and within a chamber formed by the drive head and the two cylinder barrels. The smooth rod surface is protected and does not come in contact with the pile.

The present invention can be further modified to inject pile by gripping it down. In this case, a gripping device is firmly attached to the cylinder barrels, preferably at the top or the base. The two drive heads are removed and replaced by the gripping device; the pile is pitched as before but placed through the gripping device, With the pile tightly gripped, the downward movement of cylinder barrels will cause the pile to inject into the ground. The grip is then loosened and the cylinder barrels retracted to original position, and the whole operation is repeated The present invention, if mounted on a base frame, will require a reaction load larger than the jacking force. Known reaction loads include concrete blocks or thick steel plates which are placed symmetrically with its centre of gravity in line with the jacking force. The base frame is equipped with at least four number of stabilising jacks for level adjustment, and rollers or steel pipes to allow lateral movement for pile centering. Alternatively, the present invention can be mounted onto a moving carriage like crawler crane or hydraulic excavator. In this arrangement, part of the reaction load is contributed by the machine dead load. It is possible to transfer some of this reaction load to the back of the machine, if a steel cable or chain fixed firmly and parallel to the vertical support structure and passing through a pulley, is pulled by the loading drum of the crane or a hydraulic cylinder barrel fixed onto the main same of an excavator.

BRIEF DESCRIPTION

In order that the invention may be readily understood and put into practical effect, the apparatus will now be described with reference to the accompany drawings, in which:

FIG. 1 illustrates the apparatus according to the invention mounted onto a base frame supporting the reaction load.

FIGS. 2*a* and 2*b* illustrate respectively the front view and the side view of the double hydraulic cylinder configuration utilised in apparatus of FIG. 1.

FIG. 2*c* illustrates a cross-sectional view of C section 23 taken along line X—X of FIG. 2*a*.

Figures 3A, 3B, 3C:
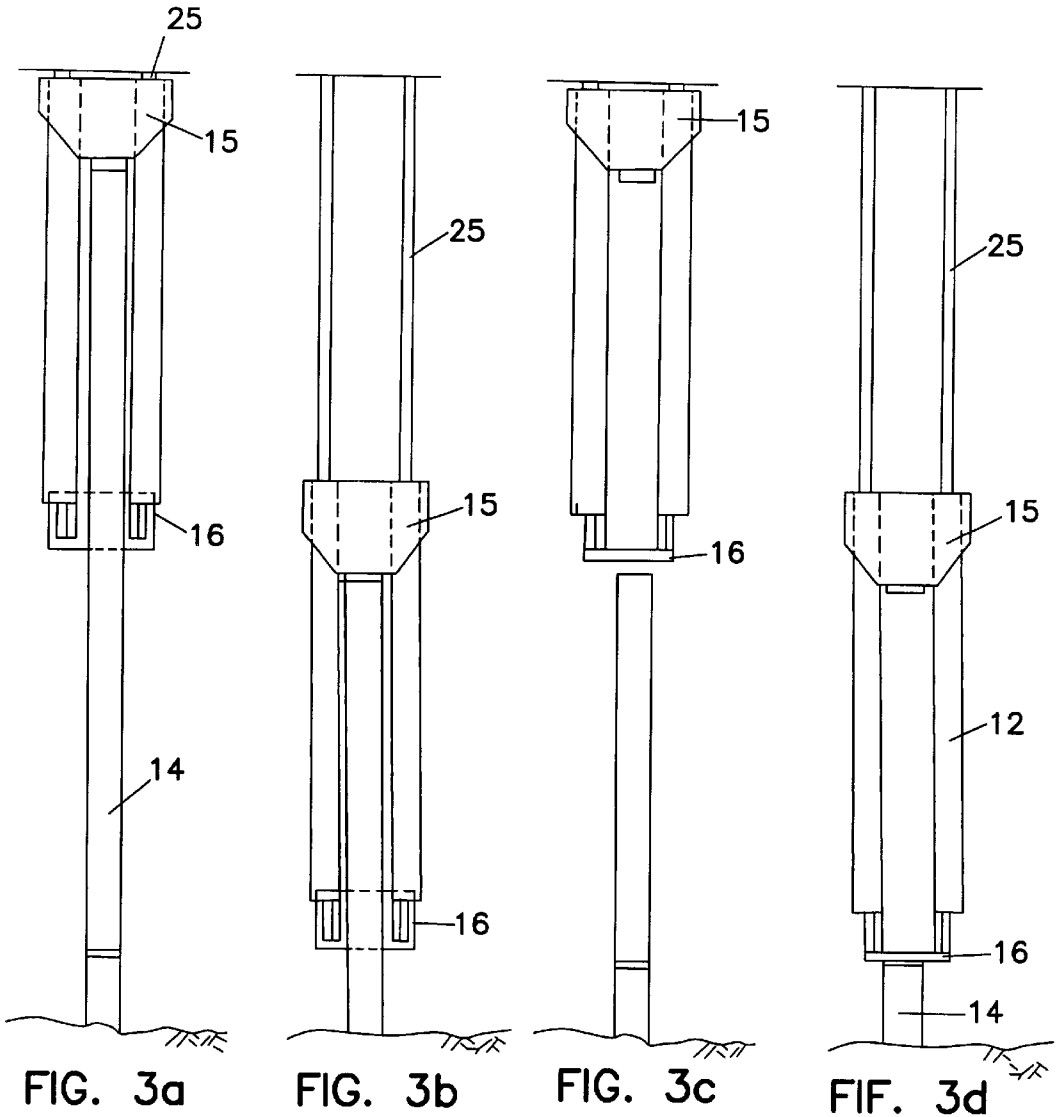

FIGS. 3*a* and 3*b* illustrate respectively the first and second positions of the double hydraulic cylinder configuration of FIG. 1, during a first stroke of the piling action.

FIGS. 3*c* and 3*d* illustrate respectively the first and second positions of the double hydraulic cylinder configuration of FIG. 1, during a second stroke of the piling action.

Figure 4B:
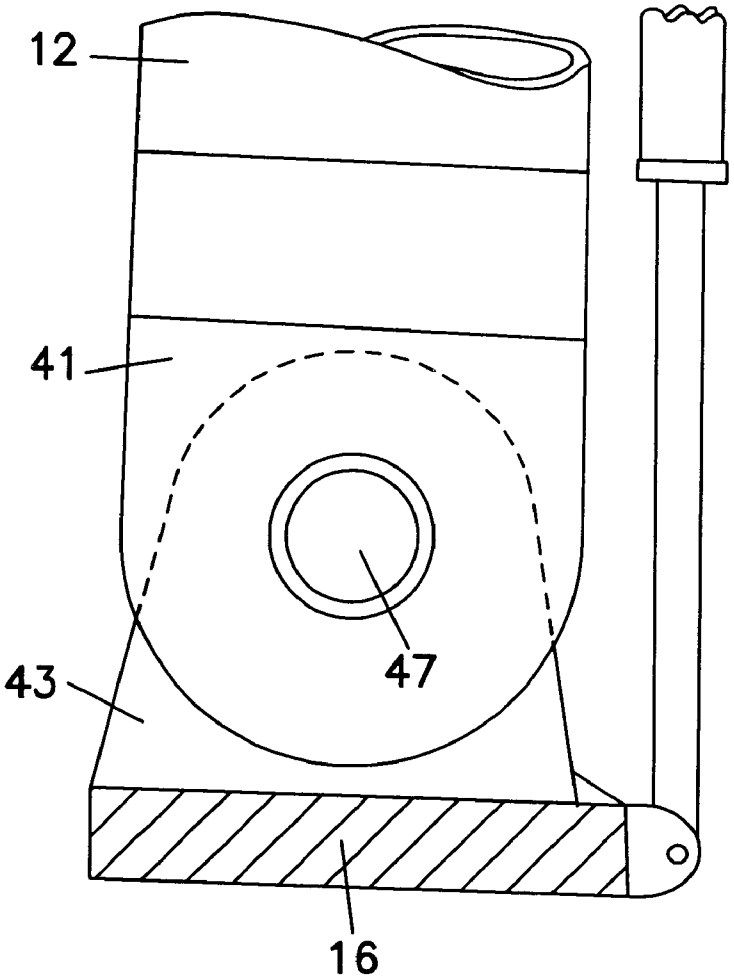
Figure 4A:
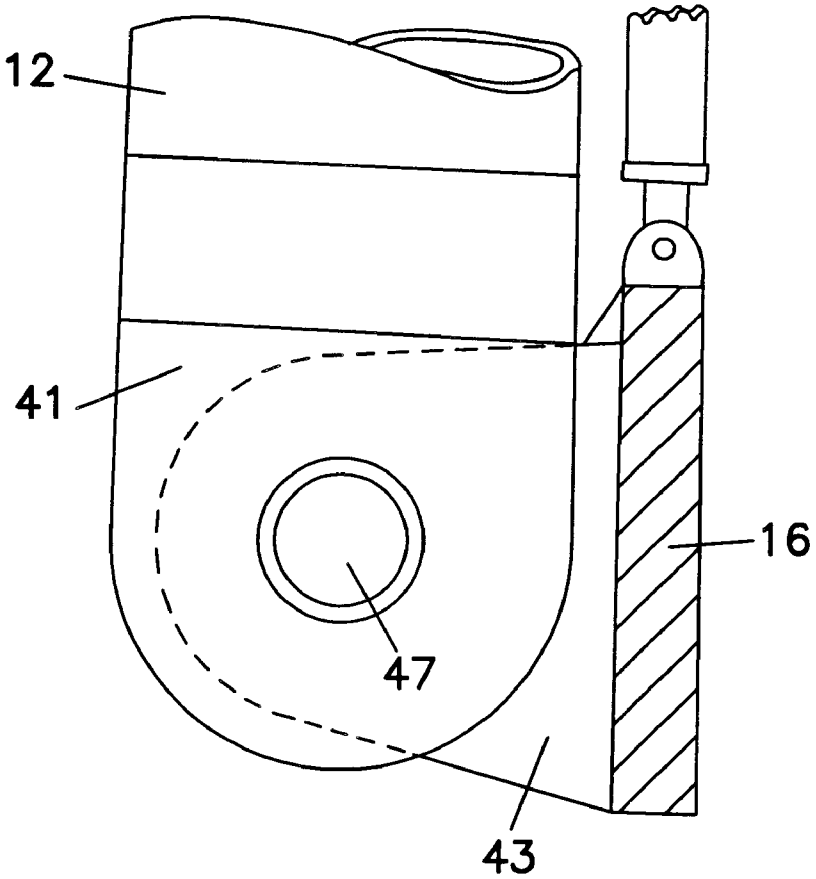

FIGS. 4*a* and 4*b* illustrate respectively the open and lock-in positions of the lower drive head attached to the double hydraulic cylinder configuration of FIG. 1.

FIG. 5 illustrates the apparatus according to the invention being mounted onto a moving carriage, such as crawler crane or hydraulic excavator.

Figure 6A:
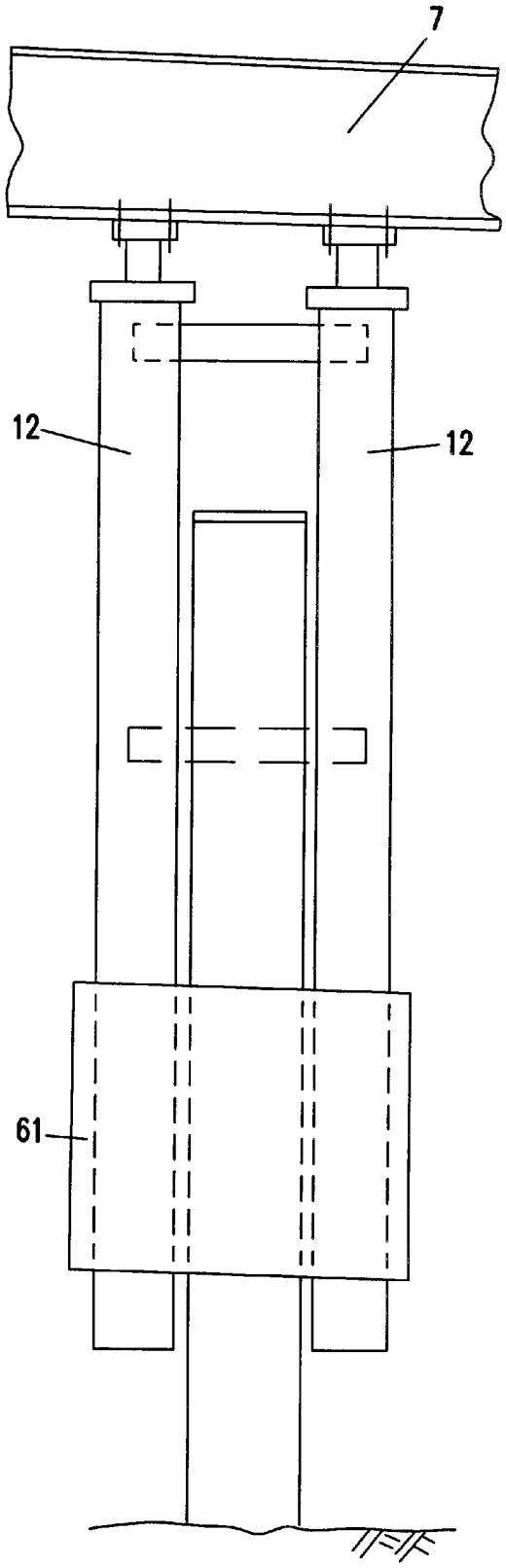
Figure 6B:
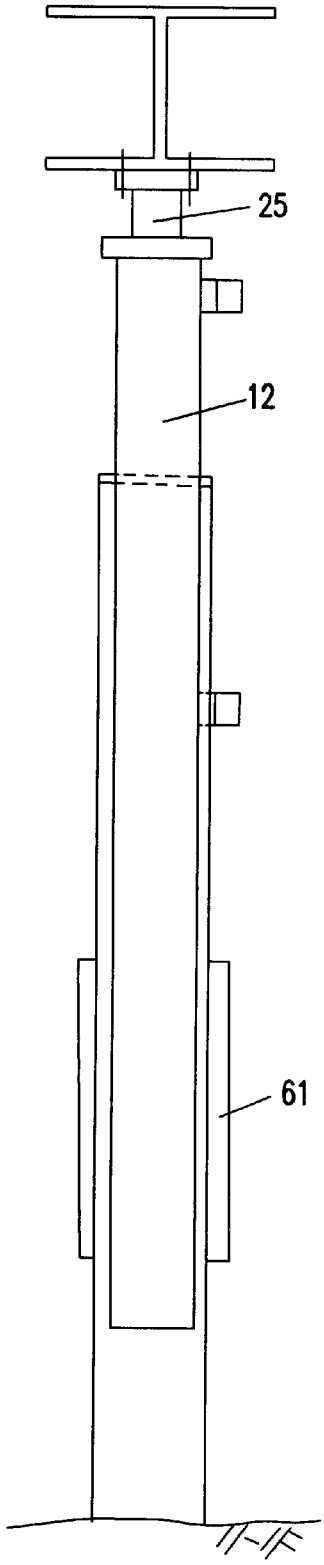

FIGS. 6*a* and 6*b* illustrate respectively the front and side views of a gripping device replacing the two drive heads of FIG. 1 and the manner a working pile is positioned.

DETAILED DESCRIPTION

The apparatus (1) according to the invention as illustrated in FIG. 1 consists essentially of two vertical support structures (13), fabricated from two strong steel E columns, and strengthened further by horizontal members at regular intervals along its length. The uppermost horizontal member (7) is a heavy steel H section. A winch (5) and a hook (3) are disposed at the top of the uppermost horizontal member (7). The end of the actuating rods (25) are attached to the bottom flange of the uppermost horizontal member (7). The top ends of two connecting struts (9) are affixed to the uppermost horizontal members (7) whereas their bottom ends are affixed to a base frame (10). Two hydraulic cylinder barrels (12) are positioned vertically side by side next to the vertical support structures (13). The ends of the actuating rods (25) are attached firmly to the uppermost horizontal member (7). The base frame (10) is made up by two platforms, preferably fabricated from steel H beams.

Movement in the horizontal plane is achieved by one upper platform rolling over one lower platform, and stability is provided by four number of hydraulic stabilisers located at the four corners of the base frame (10).

Two similar hydraulic cylinders as utilised are illustrated in FIGS. 2*a*, 2*b* and 2*c*. There are two drive heads. An upper drive head (15) is permanently welded, adjoining the top portions of cylinder barrels (12). A cap (17) is incorporated in the upper drive bead (15) to hold the working pile (14). A lower drive head (16) is attached, adjoining the base of the cylinder barrels (12), with an open and locking mechanism. The cylinder barrels (12) are further secured near the lower drive head (16) using steel C section (23) to strengthen it when in use. Hence, the cylinders are rigidly secured at the top and bottom, allowing them to slide along the vertical support structures (13) in unison. The lower drive head (16) in 'open' position together with the connecting C section (23) also serve to support the pile at its mid section. The working pile (14) is pitched and restrained from lateral movement during driving or injecting by a cap (17) provided at the upper drive head (15), and a clamp (18) near the base of the cylinder barrels (12).

A complete piling operation of the double hydraulic cylinder configuration is illustrated in FIGS. 3*a*, 3*b*, 3*c* and 3*d*. A first stroke, illustrated in FIGS. 3*a* and 3*b*, employs the upper drive head (15) to inject pile into the ground. The lower drive head (16) is in 'open' position and helps in supporting the mid section of the working pile (14). The cylinder movement in FIGS. 3*a* and 3*b* is repeated in FIGS. 3*c* and 3*d* as in a second stroke. The lower drive head (16) is in 'lock-in' position, thereby exerting a force on the pile head. As illustrated, the whole length of the pile (14) is injected into the ground at the end of the second stroke.

FIGS. 4*a* and 4*b* illustrate in greater details the lower drive head (16). The 'open' and 'lock-in' position is oriented perpendicular to each other. The change in position is assisted by another smaller hydraulic cylinder attached to the back of the two main cylinder barrels (12). A thick steel block (41) is welded to the base of each cylinder barrel (12), and a steel shaft (47) of large diameter is pinned through it with another piece carrying the lower drive head (16).

The apparatus (1) can also be mounted onto a moving carriage (55) like crawler crane or hydraulic excavator as illustrated in FIG. 5. It is possible to place some of the reaction load (51) to the rear of the carriage (55) by firmly securing a steel cable or chain (57) to the vertical support structures (13) and passing it through another pulley and connecting it to a hydraulic cylinder barrel or a crane loading drum (52) attached to the main frame of the carriage. Stabiliser (53) at the rear will provide the needed stability to prevent overturning of the carriage or machine. A reduced reaction load (8) placed around the vertical support structures (13) will allow the carriage (55) or machine to move about.

A gripping device (61) firmly attached to the cylinder barrels (12) illustrated in FIGS. 6*a* and 6*b* enables piles of various lengths to be injected. The two drive heads (15, 16) are removed to allow positioning of pile centrally through the gripping device (61).

What is claimed is:

1. A pile driving apparatus comprising two vertical support structures, stabilised by connecting struts and an uppermost horizontal member; and a hydraulic cylinder system, disposed in between the vertical support structures and the uppermost horizontal member, wherein two hydraulic cylinder barrels are employed, and disposed vertically side by side next to the vertical support structures, and the ends of actuating rods are permanently affixed to the uppermost horizontal member, and the cylinder barrels are free to move downward.

2. The apparatus of claim 1 , wherein one upper drive head permanently adjoins the mouths of the two moving cylinder barrels and one lower drive head adjoins the bases of the two cylinder barrels.

3. The apparatus of claim 2, wherein the lower drive head is further adapted with an open and lock-in mechanism, whereby the lower drive head is moved out of the path of the working pile in the open position, and the lower drive head interrupts the path of the working pile in the lock-in position.

4. The apparatus of claim 1, wherein the piling force supplied by the downward movement of the cylinder barrels is transferred to the upper drive head or the lower drive head during the piling action.

5. The apparatus of claim 3, wherein the open and lock-in mechanism is assisted by hydraulic means.

6. The apparatus of claim 1 wherein the vertical support structures are mounted onto a moving carriage allowing some of the reaction load to be located at the rear of the carriage by inducing a downward pulling force through a steel cable or chain fixed firmly and parallel to the vertical support structures, and passing through a pulley to connect to the crane loading drum or a hydraulic cylinder barrel attached firmly to the main frame of the moving carriage.

7. A method of pile driving employing the assistance of two vertical support structures, stabilised by connecting struts and an uppermost horizontal member;

a hydraulic cylinder system comprising two cylinders, each cylinder comprising a cylinder barrel and an actuating rod, disposed in between the vertical support structures and the uppermost horizontal member, the ends of the actuating rods being permanently fixed to the uppermost horizontal member; and one upper drive head permanently adjoining the mouths of the two moving cylinder barrels and one lower drive head adjoining the bases of the two cylinder barrels comprises the steps of:

retracting the hydraulic system, bringing the upper drive head near to the uppermost horizontal member;

releasing the lower drive head in an open position;

releasing a pile to be worked in between the vertical support structures and under the upper drive head;

first driving a portion of the working pile using the upper drive head in a first stroke of pile driving action;

next retracting the hydraulic system, bringing the upper drive head neat to the uppermost horizontal member;

engaging the lower drive head in lock-in position and bringing the lower drive head over the working pile;

and then driving the rest of the pile using the lower drive head in a second stroke of pile driving action.

* * * * *

UNITED STATES PATENT AND TRADEMARK OFFICE

CERTIFICATE OF CORRECTION

PATENT NO. : 6,368,023 B1
DATED : April 9, 2002
INVENTOR(S) : Lau

It is certified that error appears in the above-identified patent and that said Letters Patent is hereby corrected as shown below:

Title page,
Item [76], Inventor: "After "Sing Hian" insert -- @ --
"Jin 1/1490" should read -- Jln 1/149D --

Column 1,
Line 22, "in shift" should read -- in shifting. --

Column 3,
Line 57, "E columns" should read -- H columns --

Column 4,
Line 16, "locking mechanism" should read -- lock-in mechanism --

Signed and Sealed this

Twenty-ninth Day of October, 2002

*Attest:*

*Attesting Officer*

JAMES E. ROGAN
*Director of the United States Patent and Trademark Office*